US005685485A

United States Patent [19]

Mock et al.

[11] Patent Number: 5,685,485

[45] Date of Patent: Nov. 11, 1997

[54] APPARATUS FOR APPORTIONING AND ATOMIZING FLUIDS

[75] Inventors: Randolf Mock; Andreas Kappel, both of Munich; Hans Meixner, Haar, all of Germany

[73] Assignee: Siemens Aktiengesellschaft, Munich, Germany

[21] Appl. No.: 408,158

[22] Filed: Mar. 21, 1995

[30] Foreign Application Priority Data

Mar. 22, 1994 [DE] Germany ..... 44 09 848.0

[51] Int. Cl.[6] ..... B05B 1/08

[52] U.S. Cl. ..... 239/102.2; 239/533.12; 239/585.4; 239/596

[58] Field of Search ..... 239/102.2, 533.12, 239/585.1, 585.4, 585.5, 596, 558

[56] References Cited

U.S. PATENT DOCUMENTS

| | | | |
|---|---|---|---|
| 3,317,139 | 5/1967 | Freeland | 239/102.2 |
| 4,057,190 | 11/1977 | Kiwior et al. | 239/558 |
| 4,533,082 | 8/1985 | Maehara et al. . | |
| 4,552,311 | 11/1985 | Casey | 239/585.4 |
| 4,576,338 | 3/1986 | Klomp . | |
| 4,605,167 | 8/1986 | Maehara . | |
| 4,643,359 | 2/1987 | Casey | 239/585.4 |
| 4,669,660 | 6/1987 | Weber et al. . | |
| 4,796,807 | 1/1989 | Bendig et al. . | |
| 4,971,254 | 11/1990 | Daly et al. | 239/533.12 X |
| 4,974,780 | 12/1990 | Nakamura et al. . | |
| 5,152,456 | 10/1992 | Ross et al. . | |
| 5,199,641 | 4/1993 | Hohm et al. . | |
| 5,229,171 | 7/1993 | Donovan et al. . | |
| 5,241,858 | 9/1993 | Wiecorek et al. | 239/533.12 X |
| 5,261,601 | 11/1993 | Ross et al. . | |
| 5,330,100 | 7/1994 | Malinowski | 239/102.2 |

FOREIGN PATENT DOCUMENTS

| | | | |
|---|---|---|---|
| 23 42 470 | 3/1974 | Germany . | |
| 35 01 077 | 2/1988 | Germany . | |
| 39 12 524 | 11/1989 | Germany . | |
| 38 33 093 | 4/1990 | Germany . | |
| 41 12 150 | 3/1992 | Germany . | |
| 43 06 073 | 6/1994 | Germany . | |
| 0144012 | 12/1978 | Japan | 239/596 |
| 3222851 | 10/1991 | Japan | 239/102.2 |
| 2129875 | 5/1984 | United Kingdom | 239/533.12 |

OTHER PUBLICATIONS

G. Trausch, "Neuartige photolithographische Strukturerzeugung zur Herstellung von Präzisionsflachteilen im Galvanoplastikverfahren", Siemens–Forschungs–und Entwicklungsbericht, vol. 8, 1979, No. 6, pp. 347–352.

*Patent Abstracts of Japan*, vol. 6, No. 65 (M–124), 24 Apr. 1982 of Japanese 57–5545.

*Patent Abstracts of Japan*, vol. 9, No. 272 (M–425), 30 Oct. 1985 of Japanese 60–116848.

*Primary Examiner*—Kevin P. Shaver
*Assistant Examiner*—Steven J. Ganey
*Attorney, Agent, or Firm*—Hill, Steadman & Simpson

[57] ABSTRACT

A device is provided which allows exact apportioning and controllable atomization of fuel as necessary for various operating conditions of an internal combustion engine. The apportioning ensues with an apportioning aperture that can be closed via a valve needle. Separately therefrom, the atomization ensues with a piezoelectrically driven nozzle having an atomizer orifice placed into vibration. The shape of the atomizer aperture can be round, triangular, quadrangular or cross-like.

14 Claims, 6 Drawing Sheets

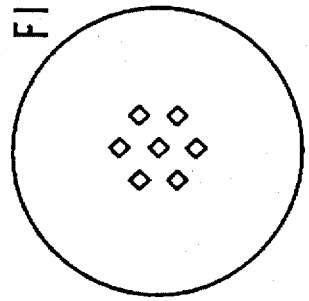
FIG 3a
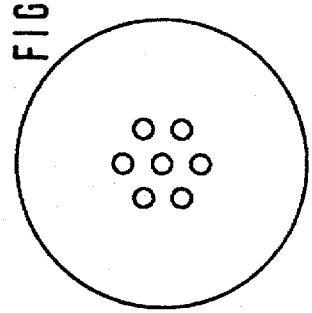
FIG 3b
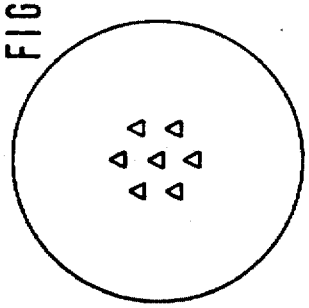
FIG 3c
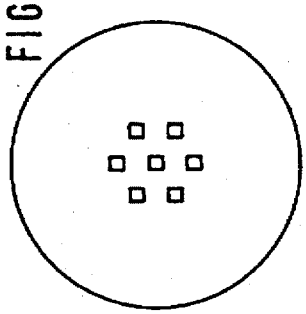
FIG 3d
FIG 3e
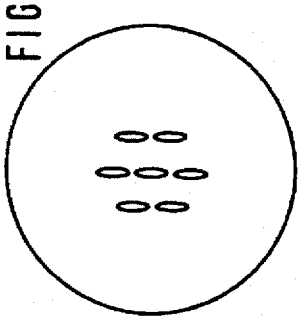
FIG 3f
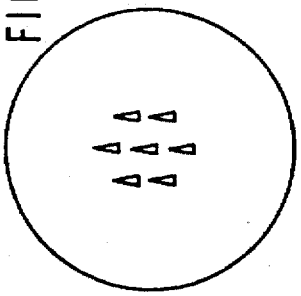
FIG 3g
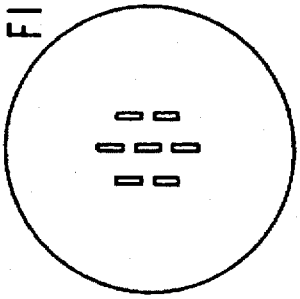
FIG 3h
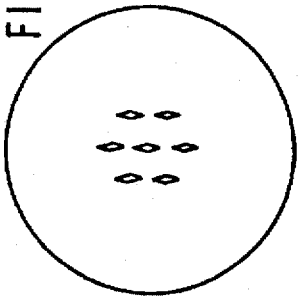
FIG 3i
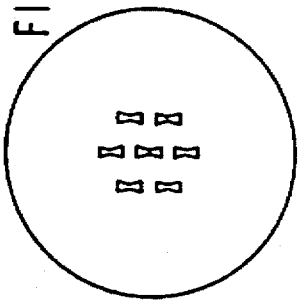
FIG 3j
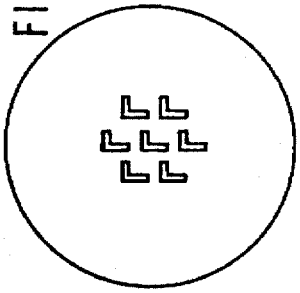
FIG 3k
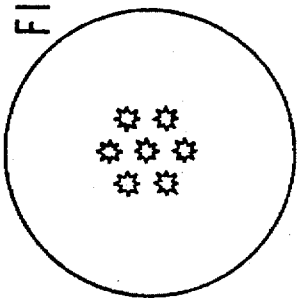
FIG 3l
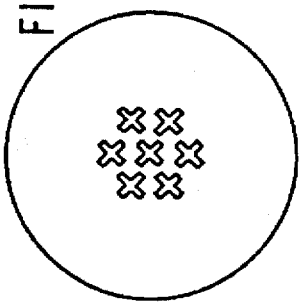

d $l_1$ $l_2$
D
λ
$l_2 < l_1$ $\eta = 0.28$ $\eta = 5$

APPARATUS FOR APPORTIONING AND ATOMIZING FLUIDS

BACKGROUND OF THE INVENTION

The present invention generally relates to fluid injectors, such as a fuel injector. More specifically, the present invention relates to a fluid apportioning device having a piezoelectric atomizer.

An internal combustion engine must be capable of proper operation in both a cold starting phase and in a continuous operation phase when the engine is steadily warmed. With respect to the cold starting phase, it is desirable that the fuel injected in the intake train of the engine proceeds into the cylinder so highly atomized for proper fuel combustion. In the continuous operation phase, i.e., when the operating temperature of all engine parts has been reached, a hot admission valve, in particular, that is suitable for fuel distribution or, respectively, evaporation is also present. Accordingly, the fuel to be injected is typically directed onto the hot valve disk with a stream-like or slightly fanned injection jet and to let it impinge thereon.

In the continuous engine operation phase, it is not advantageous to provide a greater distribution or atomization of the fuel to be injected that already proceeds directly from the injection nozzle. It has been observed that disadvantageous conditions definitely occur given fuel that is already finely distributed or atomized proceed from the nozzle, despite a high operating temperature. For instance, deposits of fuel droplets can still occur in the intake pipe that, of course, is highly heated to only a limited degree, these droplets then proceed into the cylinder only time-delayed as a result of re-evaporation. Air column vibrations in the intake pipe can lead to the fact that fuel already atomized proceeding from the nozzle does not proceed into the respective cylinder at the desired point in time. In any case, undesirable deviations from the fuel/air ratio occur, which should be observed as exactly as possible.

Published German application DE 38 33 093 A1 discloses a fuel injection valve with a controllable characteristic of the fuel jet. A fuel exit orifice or aperture of the injection valve is vibrated with a piezoelectric drive element. This vibration, which acts in the direction of the longitudinal valve axis, leads to the disintegration of the fuel stream into individual droplets according to the laws of flow mechanics. However, the arrangement disclosed by DE 38 33 093 A1 is disadvantageous in that the atomization of the fuel stream ensues from vibration of the entire valve seat. This results in a generally non-linear coupling of the fuel dosing function with the atomizer function. Since the valve states of "open" or "closed" are dependent on the momentary excursion of the valve seat, the apportioning of the fuel does not ensue linearly. The piezoelement that places the injection nozzle into vibration, this injection nozzle further providing the atomization function, is excited with a frequency above 1 kHz. Since the running of the engine produces vibrations in the frequency range between 5 kHz and 20 kHz, atomization is also undesirably induced by the engine vibration. Since both the piezostack that drives the valve needle as well as the piezoelement required for the disintegration of the stream work in longitudinal valve direction, the flow through the nozzle bore is not constant.

SUMMARY OF THE INVENTION

An object of the invention is to create an apparatus with which a fluid can be controllably atomized and with which the dosing of the fluid ensues exactly.

One advantage of the invention lies in the flexibility of the apparatus. The atomizer function can be simply adapted to the respective use conditions. The apportioning can likewise be simply set to the environmental conditions independently and regardless of the atomizer function.

In the present invention, which provides an apparatus for apportioning and atomizing fuel for internal combustion engines, the object is thus achieved in that a functional separation ensues between fuel dosing and fuel atomization. The aperture cross section of the valve exit defines the quantity of fuel that emerges. A second aperture that is provided in the injector plate and follows the valve exit aperture is periodically varied in cross section and in terms of its position in order to correspondingly increase or diminish the surface tension of the emerging fuel, this leading to an atomization of the fuel.

To this end, an apparatus is provided for apportioning and atomizing a fluid. The apparatus includes a housing having an apportioning aperture through which the fluid flows. A closing element is movably disposed in the housing and is operable to close or open the apportioning aperture. At least one atomizer orifice is disposed downstream of the apportioning aperture. A drive element causes the atomizer orifice to vibrate. In an embodiment, the atomizer orifice vibrates relative to the apportioning aperture.

In an embodiment, the apparatus includes an atomizer plate within which the atomizer orifice is disposed. The atomizer plate is disposed proximal to the apportioning aperture.

In an embodiment, the apparatus includes a carrier plate on which the atomizer plate is mounted, the carrier plate being operably secured to the drive element. In a related embodiment, the atomizer plate is joined to the carrier plate non-positively.

In an embodiment, the drive element is a piezoelectric element.

In an embodiment, a spring biases the carrier plate against the drive element and provides a mechanical prestress on the drive element.

In an embodiment, an outer cap is secured over the housing, the outer cap supporting the spring.

In an embodiment, the apportioning aperture is vibrated at a resonant frequency thereof.

In an embodiment, at least one atomizing orifice has a diameter of 10 to 20 μm. In a related embodiment, at least one other atomizing orifice has a diameter of more than 20 μm.

In an embodiment, an orifice has a shape selected from a group including: round, oval, triangular, rectangular, polygonal or star-shaped.

In another embodiment, the present invention provides a fuel injector for delivering repeated doses of fuel. The fuel injector includes an apportioning aperture through which the fuel flows. An atomizer orifice is provided through which said fuel flows after flowing through the apportioning aperture. A drive element is operable to vibrate the atomizer orifice relative to the apportioning aperture.

In an embodiment, the drive element has a first end and a second end, and the fuel injector further includes a housing against which the apportioning aperture and the first end of the drive element are secured. The atomizer orifice is secured against the second end of the drive element and spaced from the apportioning orifice.

In an embodiment, the drive element is a piezoelectric drive element. A piezoelectric drive element is well suited because of its high-frequency vibration.

In an embodiment, the atomizer orifice vibrates in a reciprocating direction along a general direction of the flow.

Thus, it is advantageous to mount the injector plate, which comprises an atomizer aperture on a carrier plate which is coupled to the drive element. Thus, the injector plate, which is well-suited for the transmission of vibration, can be driven by the drive element.

The apparatus is especially suited for the apportioning and atomization of fuel for internal combustion engines.

Additional features and advantages of the present invention are described in, and will be apparent from, the detailed description of the presently preferred embodiments and from the drawings.

BRIEF DESCRIPTION OF THE DRAWINGS

FIGS. 3*a–l* show a variety of possible injector plates with various nozzle holes which can be used according to the present invention.

DETAILED DESCRIPTION OF THE PRESENTLY PREFERRED EMBODIMENTS

Figure 1:
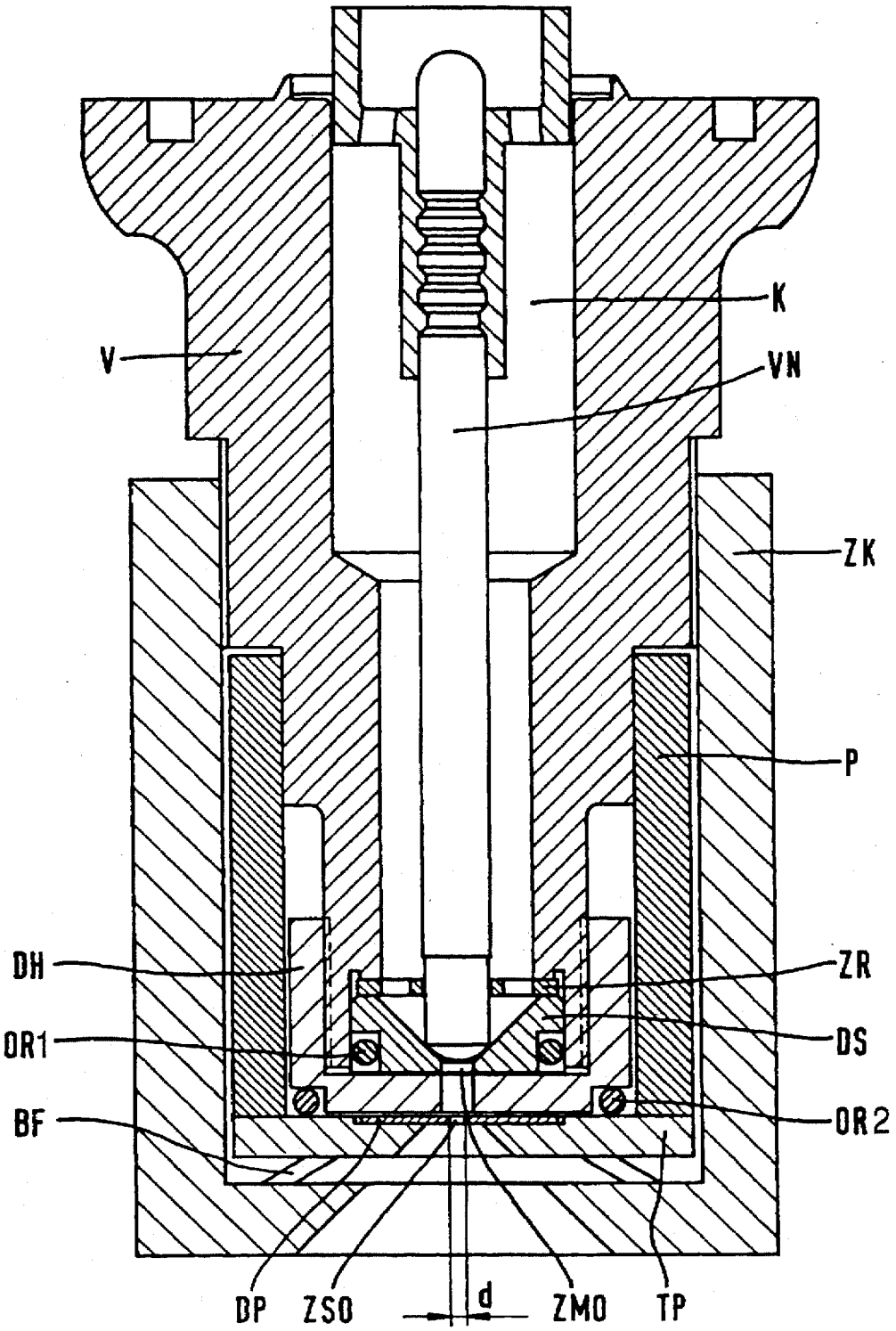
FIG. 1 shows a valve block with an atomizer.

A device is provided, as shown in FIG. 1, which is suitable for apportioning and atomizing fuel for an internal combustion engines. The device includes a valve housing V within which a closing element or valve needle VN is movably disposed. The valve needle VN is seatable against a valve seat DS secured in a nozzle tip of the valve housing V. A centering ring ZR has a central hole through which the valve needle VN is centrally guided. A resilient O-ring OR1 is disposed between a recess of the valve seat DS and the valve housing V. A threaded cap DH screws onto the nozzle tip of the valve housing to retain the valve seat DS in place. The valve needle VN can be axially driven, for example, with a mechanism such as that disclosed in German patent application P 43 06 073.0.

Fuel flows through a channel K in the direction of the valve seat DS. When the valve needle VN presses against the valve seat DS, the fuel flow is inhibited. When the valve needle VN lifts off from the seal seat, the fuel flows through a valve exit aperture or apportioning aperture ZMO in the valve seat DS, through a bore in the nozzle cap DH and through an atomizer according to the present invention, then exiting the device.

The atomization is effected by an atomizer plate DP (also referred to as injector plate or thin orifice disk or membrane) having a circular atomizer orifice ZSO of a very narrowly toleranced geometry in the center. A diameter d of the atomizer orifice ZSO has a tolerance generally around 1 μm with a precisely defined corner rounding of the edge of the aperture. The atomizer plate DP with the atomizer orifice ZSO is secured centrally on a rigid carrier plate TP. The atomizer plate DP, for example, can be connected to the carrier plate TP in a positive manner, such as by welding. An outer edge of the carrier plate TP is secured to a drive element P, a piezoceramic, that is in turn supported at the valve housing V.

The overall arrangement is located in an outer cap ZK that is secured over the valve housing V. A spring BF is disposed between the outer cap ZK and the carrier plate TP under compression. Biased against the piezoelectric drive element P, the spring BF provides a necessary mechanical prestress for proper operation of the piezoceramic P. The spring BF can be any suitable spring such as a leaf spring. Nozzle parts in the region of the apportioning aperture ZMO are retained together with the screw-on nozzle cap DH. Specifically, the cap DH retains the valve seat DS, the O-ring OR1, and the centering ring ZR. An O-ring OR2 is disposed between the carrier plate TP and the cap DH.

When a periodic alternating voltage, for example a sinusoidal voltage, is applied to the piezoceramic P, the carrier plate TP and the atomizer plate DP are caused to vibrate. The vibration is at a preferably non-resonant frequency, however, in an embodiment, resonant vibration is possible. This forced movement of the membrane or atomizer plate leads to the disintegration of the fuel stream into small drops according to a theory of vibration-induced production of liquid droplets developed by Lord Rayleigh. The optimum excitation frequency in the case of the arrangement according to FIG. 1 is approximately 5 kHz; however, an effective excitation of the injector plate for stream disintegration can also be achieved with other frequencies.

Figure 2:
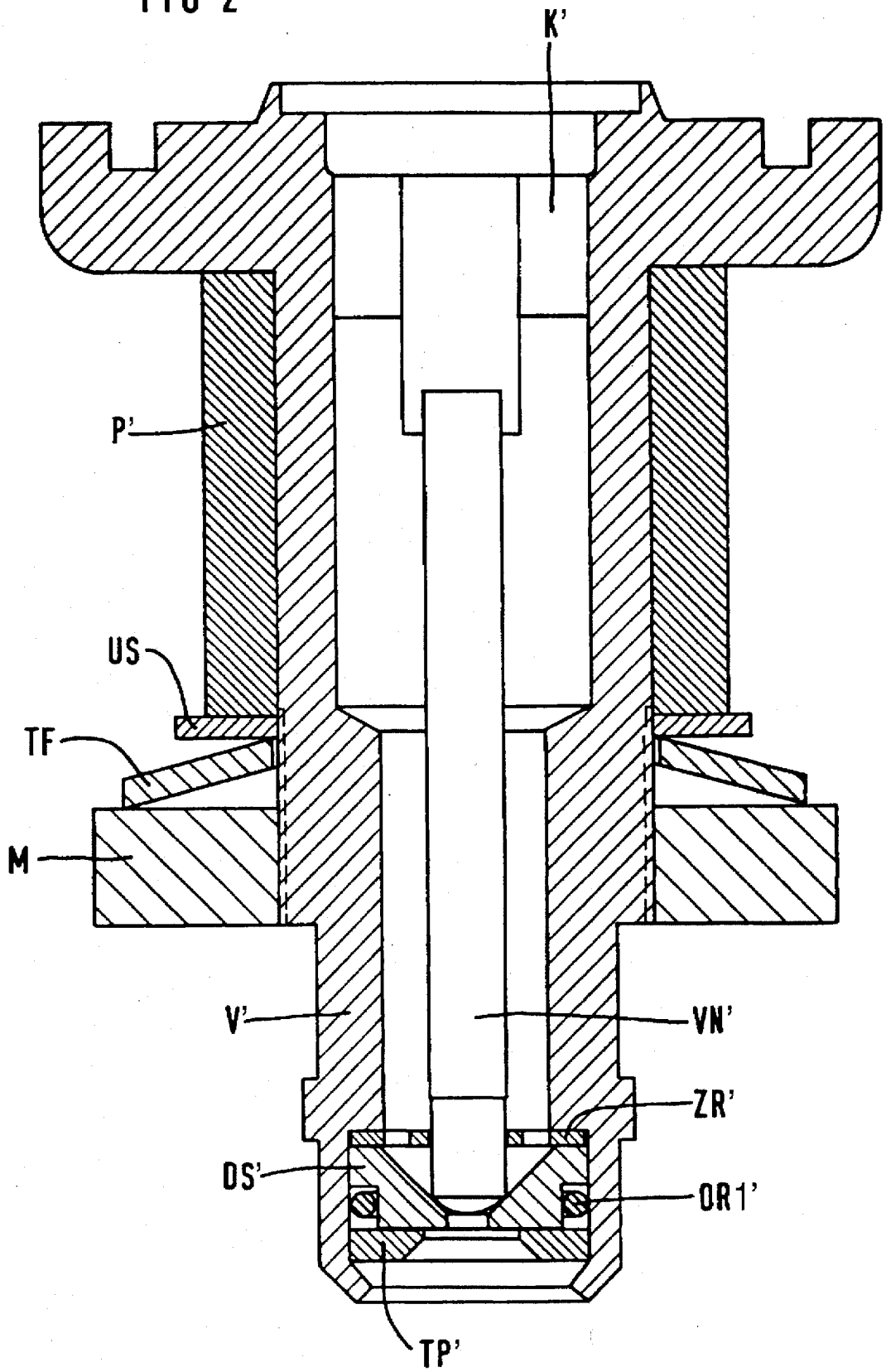
FIG. 2*a* shows another embodiment of the valve block with an atomizer.

By contrast to the embodiment set forth in FIG. 1, an atomizer component set forth in FIG. 2 is excited in the resonant frequency range at approximately 130 kHz. The piezoelement P' is again supported at the valve housing V'. The mechanical prestress of the piezoelement P' can be set with a nut M and a disk spring TF. A washer US provides a uniform distribution of pressure onto the piezoelement P'. As in the embodiment set forth in FIG. 1, an atomizer plate DP' is caused to vibrate, this leading to the disintegration of the liquid according to the aforementioned Rayleigh flow theory.

Compared to the illustration in FIG. 1, the internal valve parts, i.e., a centering ring ZR', a valve seat DS', an O-ring OR1', the valve needle VN' and the injector plate are held together by an inward curving of a tip of the valve housing V'. The solutions shown in FIGS. 1 and 2 each result in atomization of the flow. Dependent on the specific application, the mounting of the internal valve parts shown in FIG. 1 or that shown in FIG. 2 should be selected.

In order to be able to exactly dose the fuel, dead volume in the space between the fuel apportioning aperture ZMO and the atomizer orifice ZSO is minimized. The envelope DH of the inside valve parts shown in FIG. 1 is therefore designed such that only a minimum dead volume exists between the atomizer plate DP and the valve seat DS.

The membrane or atomizer plate DP can be shaped like a spherical cap during manufacture for defining the emission direction.

The invention is particularly effective for low-pressure injection applications at approximately 1–10 bar.

The area of employment of the invention is not limited to the apportioning and atomizing of fuel for internal combustion engines but can be utilized anywhere that a fluid must be exactly dosed and the possibility of atomization must be established.

The excitation frequency F of the piezoelement P that places the atomizer plate DP into vibration is to be matched to the diameter d of the atomizer orifice of the atomizer plate DP. The penetration depth into the fluid is all the less the higher the excitation frequency F. The following relationship derives between the excitation frequency F and the orifice diameter d of the atomizer:

$$d \sim \frac{1}{F^2}$$

with d=diameter of the nozzle aperture and F=excitation frequency of the piezoelement that places the atomizer orifice ZSO or, respectively, the injector plate DP into vibration.

Figures 4A, 4B, 4C, 4D:
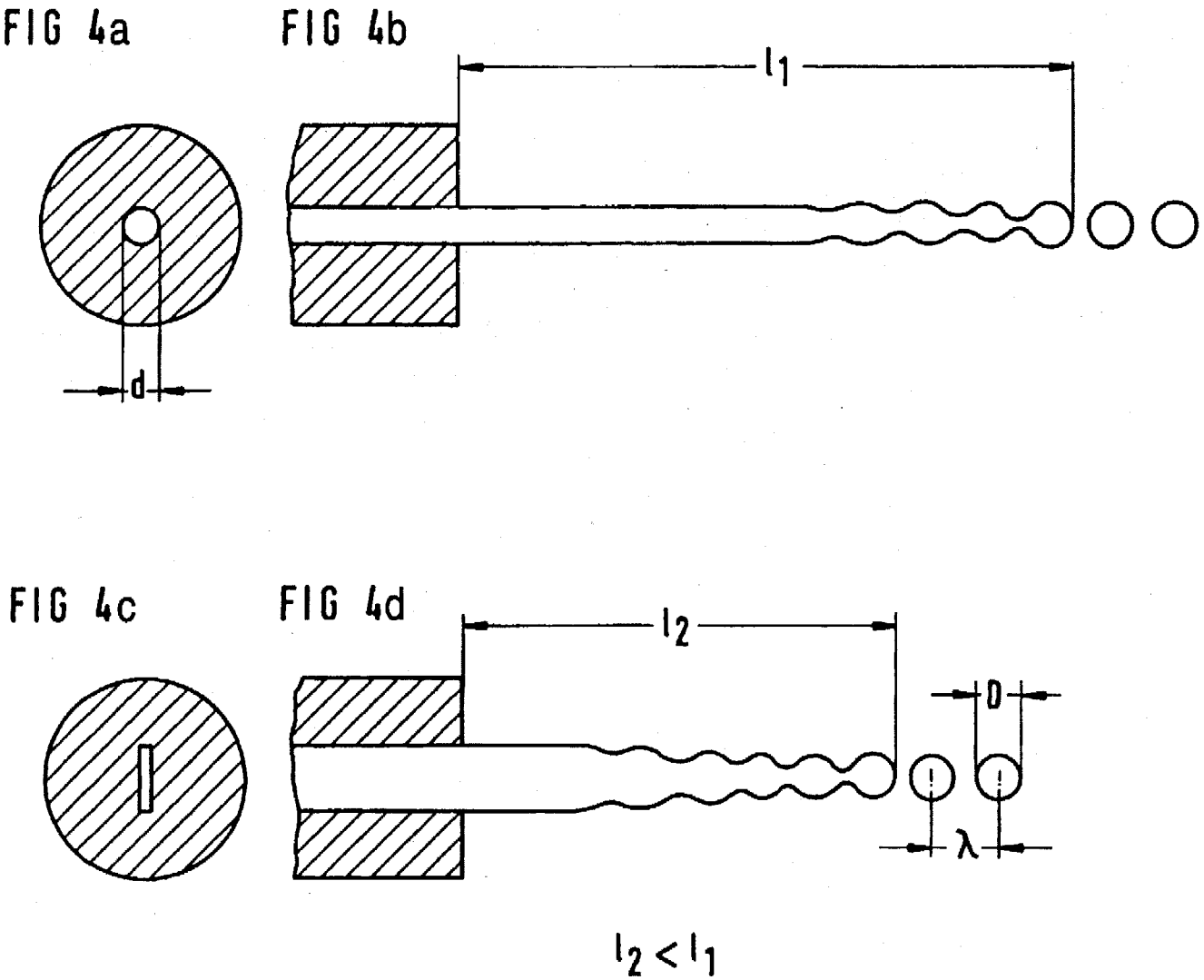
FIG. 4 shows the stream disintegration given a round nozzle hole compared to that given a rectangular nozzle hole.

FIGS. 3*a–l* show various injector plates suitable for assisting the stream disintegration. The injector plate as shown in FIG. 3*a* comprises a plurality of round apertures whose diameters amount to less than 100 μm. Given the injector plates as shown in FIGS. 3*a–l*, the aspect ratio lies at approximately 1.5–5, i.e. the length of the nozzle aperture is greater by a multiple compared to the diameter of the nozzle aperture. Further aperture shapes that are especially suitable are shown in FIGS. 3*g* and 3*l*. The atomizer plate apertures can have nearly arbitrary shapes. As shown in FIG. 4, the asymmetry of the flow forces and surface tension forces induced by a non-circular cross sectional area of the emerging fuel stream leads to an intensification of the periodic surges of the stream cross section, as a result whereof an accelerated disintegration of the liquid into extremely small drops is effected. Given a laminar nozzle flow, the following relationships between the drop spacing λ, the drop diameter D and the diameter d of the nozzle aperture are thereby valid in a first approximation (given a non-circular cross sectional area of the nozzle the substitute diameter of a circular nozzle that is equivalent to the cross sectional area of the nozzle is to be employed instead of the diameter d of the nozzle aperture):

$$\lambda \cong 4.5 \cdot d$$

$$D \cong 1.9 \cdot d$$

Differing from an approximately constant drop size given a laminar flow, turbulent flow events lead to a characteristic distribution of drop size, i.e., considerable proportions of small-volume and high-volume drops are contained in the resulting droplet spray, in addition to the frequent occurrence of an average drop size. This effect that is often utilized for atomization can be intensified by especially extreme cross sectional profiles having sharp points and edges, as shown in FIGS. 3*f, g, h, i, j, k, l*. In this case, the nozzles have the function of turbulators.

As shown in FIG. 4, a cross sectional nozzle shape deviating from the circular shape effects an earlier disintegration of the liquid stream into individual drops. The liquid emerging from a round nozzle aperture disintegrates into individual drops at the distance $l_1$, by contrast whereto a liquid passing through a rectangular cross sectional shape already disintegrates into individual drops at the distance $l_2$, whereby $l_2 < l_1$ applies.

Figure 5:
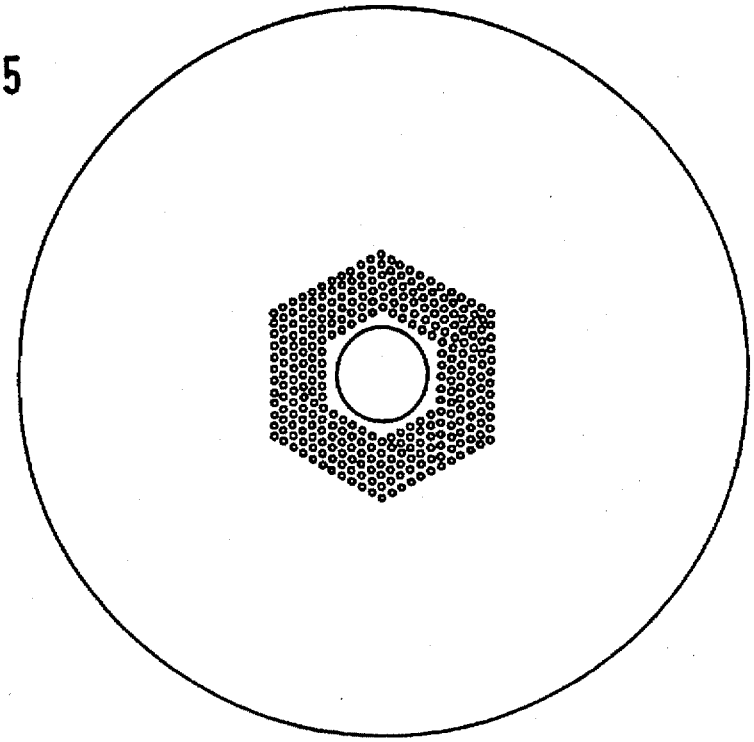
FIG. 5 shows a possible combination of various nozzle hole diameters in an injector plate.

In addition to the shape of the nozzle apertures, the arrangement and size of the nozzle apertures on the injector plate can also be varied within broad limits, as shown in FIG. 5. In its center, the injector plate DP has a large nozzle aperture that is surrounded by many small nozzle apertures in the form of a hexagon. The stream properties can be adapted to various requirements by combining various nozzle aperture sizes, nozzle aperture shapes and the nozzle aperture arrangement on an injector plate. Different operating conditions of the engine can thus be covered better since, on the one hand, a more uniform fuel/air mixture is produced by a fine aerosol jacket, as a result whereof the wall wetting and the emission of pollutants are reduced during a cold start. At the same time, a good power output can be achieved with a compact central stream in an engine heated to operating temperature. Additionally, the risk of blockage in the nozzle is reduced.

Figure 6A:
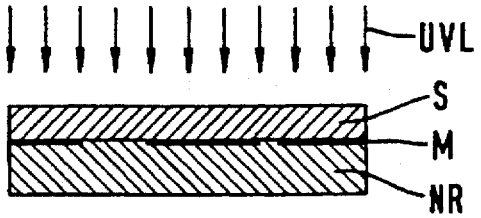
FIGS. 6*a–c* show the fundamental galvanoplastic manufacturing method for an injector plate.
Figure 6B:
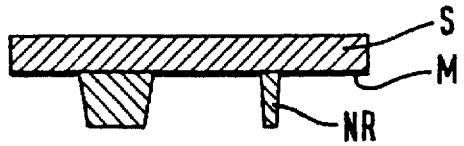
Figure 6C:
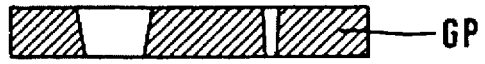

Such injector plates can be manufactured according to a galvanoplastic process according to the Siemens microstructure technique (MS). As shown in FIGS. 6*a–c*, a negative photo-resist NR laminated onto a substrate S is irradiated with ultraviolet light UVL through an extremely thin mask M previously produced by photostructuring and connected to the substrate S in the Siemens microstructure technology. Synchrotron radiation can also be employed for exposing the negative photoresist NR. Subsequently, the non-irradiated portion of the photo layer-resist NR is rinsed out in the developer. The previous mask M can then be voltaically reinforced at the uncovered locations, the negative photoresist NR can thus be shaped up to just about its full height and the additively produced metal layer of, for example, Ni, Cu, Au or Ag can be chemically or mechanically separated as a desired flat part. Moreover, manufacturing double nozzles (e.g., one admission and two nozzle outlets, oblique nozzles or nozzles having conical or exponential admission funnels) is possible with specific exposure techniques and photoresists. This is described in Trausch Guenter, "Neuartige photolithographische Strukturerzeugung zur Herstellung von Präzisionsflachteilen im Galvanoplastikverfahren", Siemens-Forschungs-und Entwicklungsbericht, Vol. 8, 1979, No. 6. FIG. 6*c* shows the finished galvanoplastic GP in cross section.

Figure 7A:
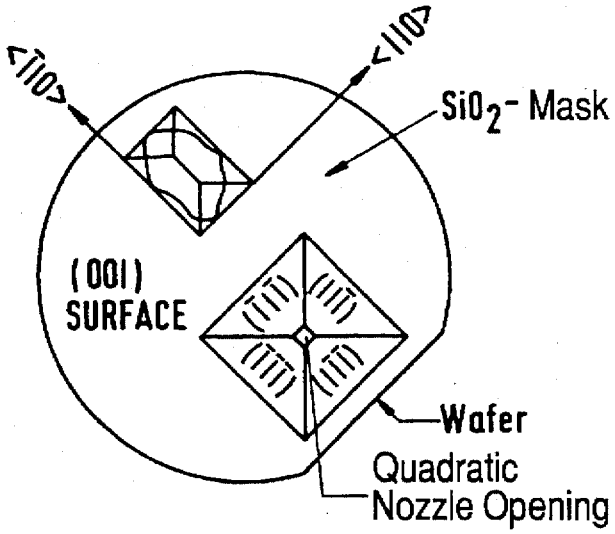
FIGS. 7*a* and 7*b* show a nozzle having a quadratic nozzle hole in a plan view and in cross section in an anisotropic etching process.
Figure 7B:
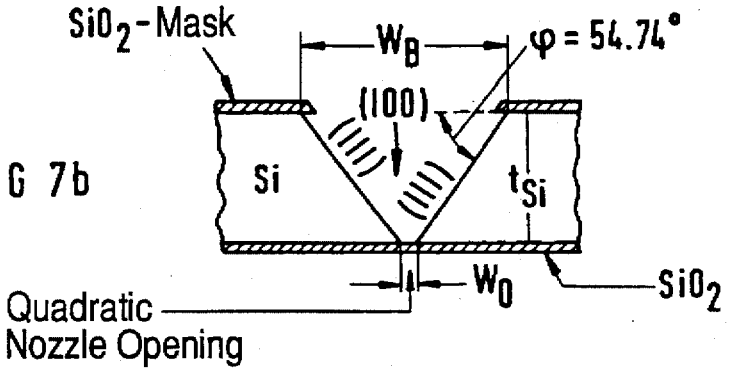

Another means for manufacturing the injector plates employs an anisotropic etching technique. The etching rate that differs greatly dependent on crystallographic orientation in some single-crystal materials such as silicon and gallium in specific etching solutions such as EDP (ethylene diamine) or KOH is utilized. As shown in FIG. 7, a Si substrate that, for example, is (100) oriented is first provided for this purpose with a both-sided etchstop layer, for example in the form of $SiO_2$ or $Si_3N_4$, into which quadratic openings having the length $W_B$ are etched at one side, whereby the edges of the uncovered regions must be aligned parallel to the crystallographic (110) directions of the substrate. During the self-stopping wet-etching process in EDP or KOH which follows thereupon, pyramid-shaped depressions having (111) oriented sidewalls with a slope of $\phi$=54.74° arise. Given a suitable dimensioning of the etching window $W_B$, quadratic clearances having an edge length $W_0$ of $$W_0 = W_B - \sqrt{2} \cdot t_{si},$$

form, whereby $t_{Si}$ is the thickness of the Si substrate. The nozzles are subsequently uncovered by etching the $SiO_2$ or $Si_3N_4$ etchstop layer off. Manufacturing rectangular nozzle cross sectional shapes is also possible in this method.

Figure 8A:
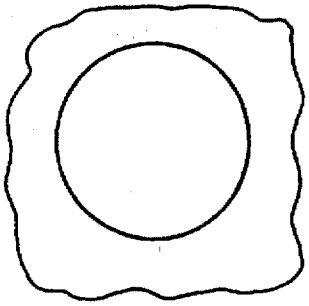
FIG. 8*a* illustrates a conventional nozzle in comparison to FIG. 8*b*, which illustrates a plurality of new nozzles in plan view and in cross section according to the present invention.
Figure 8B:
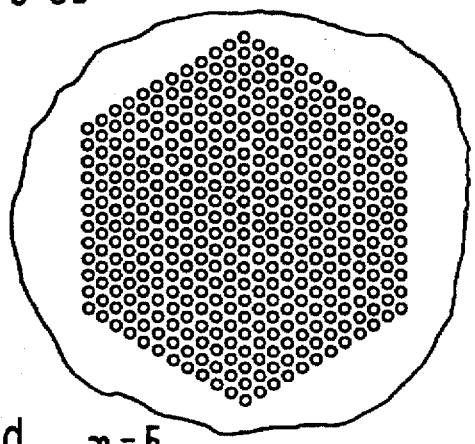
FIGS. 8*c* and 8*d* show side views of FIGS. 8*a* and 8*b* respectively.
Figure 8C:
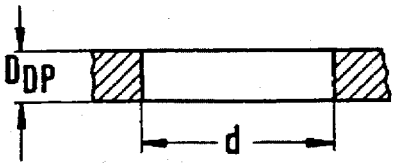
Figure 8D:
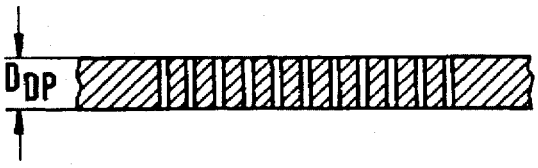

FIG. 8 shows a comparison of a conventional nozzle in plan view and in cross section (FIG. 8*a*) to a plurality of hexagonally arranged nozzles as set forth above (FIG. 8*b*). Previously standard nozzle diameters d lay in the range from approximately d =0.3 mm through d=0.6 mm given typical thicknesses of the injector plate of approximately $D_{DP}$=0.05 through 0.15 mm. Approximately η=1.5–5 derives therefrom as aspect ratio. Nozzle apertures having aspect ratios of η≧0.5 can be manufactured with the assistance of photostructuring techniques in combination with voltaic shaping techniques or anisotropic etching techniques, see FIG. 8*b*. Given employment of synchrotron emission for exposing the photoresist, aspect ratios of η>100 are even possible. The nozzle diameter d of each and every nozzle lies at approximately 20 μm. The thickness of the injector plate amounts to approximately $D_{DP}$=100 μm.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. An apparatus for apportioning and atomizing a fluid comprising:

a housing;

an apportioning aperture through which the fluid flows, the aperture being fixed to said housing;

a closing element movably disposed in the housing operable to close or open the apportioning aperture;

at least one atomizer orifice disposed downstream of the apportioning aperture;

a drive element causing the atomizer orifice to vibrate relative to the apportioning aperture;

means for biasing a carrier plate against the drive element and providing a mechanical prestress on the drive element; and an outer cap secured over the housing, the outer cap supporting the biasing means.

2. The apparatus according to claim 1, further comprising:

an atomizer plate within which said atomizer orifice is disposed, the atomizer plate being disposed proximal to the apportioning aperture.

3. The apparatus according to claim 2, wherein the atomizer plate is mounted to the carrier plate, and wherein the carrier plate is operably secured to the drive element.

4. The apparatus according to claim 3 wherein the atomizer plate is joined to the carrier plate non-positively.

5. The apparatus according to claim 1, wherein the drive element is a piezoelectric element.

6. The apparatus according to claim 1 wherein said means for biasing includes a spring.

7. The apparatus according to claim 1 whereby the apportioning aperture is vibrated at a resonant frequency thereof.

8. The apparatus according to claim 1 including at least one atomizing orifice with a diameter of 10 to 20 μm.

9. The apparatus according to claim 8 further including at least one atomizing orifice with a diameter of more than 20 μm.

10. The apparatus according to claim 9 wherein at least one orifice has a shape selected from the group consisting of:

round, oval, triangular, rectangular, polygonal and star-shaped.

11. The apparatus according to claim 8, wherein at least one orifice has a shape selected from the group consisting of:

round, oval, triangular, rectangular, polygonal and star-shaped.

12. The apparatus according to claim 1 wherein the apparatus is for fuel apportioning and atomization in an internal combustion engine.

13. A fuel injector delivering repeated doses of fuel, said fuel injector comprising:

a housing;

an apportioning aperture through which said fuel flows, said apportioning aperture being fixed relative to said housing;

a drive element having a first end secured to said housing and a second end;

an atomizer plate having an atomizer orifice through which said fuel flows after flowing through said apportioning aperture, said atomizer plate being fixed to said second end of said driving element so that said drive element is operable to vibrate said atomizer orifice relative to said apportioning aperture; and an outer cap generally covering the driving element and atomizer plate, the outer cap being mounted to said housing.

14. The fuel injector according to claim 13 wherein said drive element is a piezoelectric drive element.

* * * * *